United States Patent [19]

Turnidge et al.

[11] Patent Number: 5,071,131

[45] Date of Patent: Dec. 10, 1991

[54] GOLF BALL DISPENSER COMPRISING TAPERING U-SHAPED CONTAINER AND SINGLE-BALL GUIDE CHANNEL

[75] Inventors: Howard M. Turnidge; Theodore Talvan, both of Redlands, Calif.

[73] Assignee: Howco Trust, Sacramento, Calif. ; Howard M. Turnidge, Trustee

[21] Appl. No.: 689,090

[22] Filed: Apr. 22, 1991

Related U.S. Application Data

[60] Continuation of Ser. No. 532,687, Jun. 4, 1990, abandoned, which is a division of Ser. No. 31,563, Mar. 30, 1987, Pat. No. 4,957,296, which is a continuation of Ser. No. 746,129, Jun. 18, 1985, abandoned.

[51] Int. Cl.[5] ..... A63B 57/00

[52] U.S. Cl. ..... 273/201

[58] Field of Search ..... 273/201

[56] References Cited

U.S. PATENT DOCUMENTS

| | | | |
|---|---|---|---|
| 1,797,540 | 10/1930 | Haynes | 273/201 |
| 1,969,139 | 8/1934 | Knapp | 273/201 |
| 2,152,680 | 4/1939 | Blaski | 273/201 |
| 2,711,321 | 6/1955 | McGraw, Sr. | 273/201 |
| 2,789,824 | 4/1957 | Willcox | 273/201 |
| 3,075,774 | 1/1963 | Buell | 273/201 |
| 4,441,717 | 4/1984 | Willcox | 273/201 |
| 4,796,893 | 1/1989 | Choi | 273/201 |
| 4,815,744 | 3/1989 | Diamandis | 273/201 |

FOREIGN PATENT DOCUMENTS

| | | | |
|---|---|---|---|
| 2129310 | 5/1984 | United Kingdom | 273/201 |

*Primary Examiner*—Theatrice Brown

*Attorney, Agent, or Firm*—David Pressman

[57] ABSTRACT

An improved golf-ball dispenser provides the dual purpose of supplying a single file of golf balls to a teeing device and providing an independent golf-ball dispenser. The dispenser automatically feeds golf balls in single file at an exit end of the dispenser after a multitude of golf balls have been dumped into the container. This is accomplished by gravity produced by sides (15) which slope toward the center near the exit end (13) and also by the downward slope toward the exit end (13) and from the back (23) of the dispenser. There is a gradual reduction in width of the opening toward the exit end (13). A guide channel (12) is positioned within the enclosure so as to receive a single file of golf balls at the proper moment to prevent overlapping, hangups, or errant golf balls from leaving the guide track (12). The golf ball dispenser is used by the golfer for more convenience in putting, chipping, pitching, or driving practice.

2 Claims, 6 Drawing Sheets

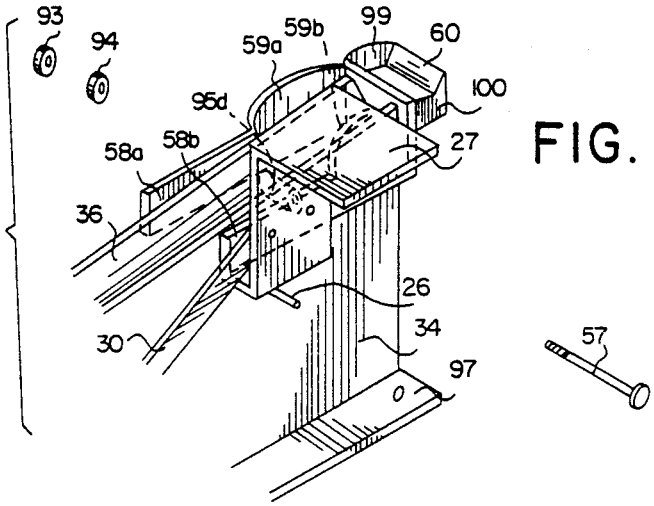
FIG. 3
FIG. 8
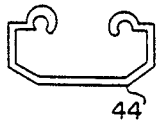
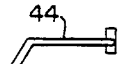
FIG. 9
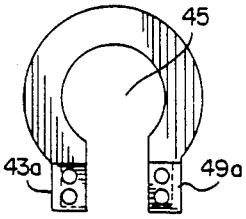
FIG. 4
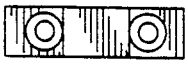
FIG. 5
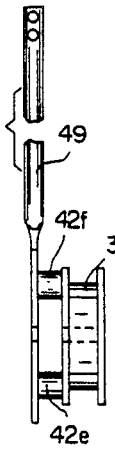
FIG. 6
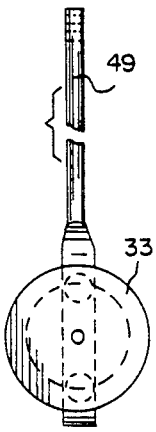
FIG. 7

GOLF BALL DISPENSER COMPRISING TAPERING U-SHAPED CONTAINER AND SINGLE-BALL GUIDE CHANNEL

CROSS-REFERENCE TO RELATED APPLICATIONS

This application is a continuation of Ser. No. 07/532,687, filed Jun. 4, 1990, now abandoned; which is a division of Ser. No. 07/031,563, filed Mar. 30, 1987, U.S. Pat. No. 4,957,296; which is a continuation of Ser. No. 06/746,129, filed Jun. 18, 1985, now abandoned. U.S. Pat. No. Des. 291,342, granted 1987-08-11, and titled "Golf Ball Dispenser", relates to the outer appearance of a golf ball dispenser suitable for use with the dispenser of this invention.

BACKGROUND

1. Field of the Invention

This invention relates to golf, particularly to a device for dispensing golf balls for play.

2. Prior Art

Heretofore golf ball teeing devices and dispensers have been provided for use by golfers who desired to practice from fixed teeing locations to improve their golfing skills. One such device was designed with a circular housing containing a spiral track or tube to feed golf balls to a teeing device in single file. Another golf ball dispenser had a platform placed in the ground so that its top surface was flush with the ground, and all feed mechanisms were below ground. several such devices have used actuating mechanisms which were attached to tees connected to springs, levers, counterweights, and pivoted platforms. However, they all suffered from a number of important disadvantages. A multitude of mechanisms and installation requirements led to complex operations.

There are a number of golf ball dispensers attached to teeing devices, but none of these are designed to operate as an independent dispenser. Helical golf ball dispensers are common in conjunction with teeing devices. Coin-operated dispensers are currently being used at golf ball driving ranges. Currently it has been noted that there are at least four golf ball dispensers and teeing devices being advertised in golf catalogs, and some of these have been designed for golf-ball driving ranges. Other such devices have been patented, but few have made it into the marketplace.

Prior art dispensers do not operate independently of a teeing device, sloping downward as is claimed, and employing a container having facing side walls, each with two portions, one facing the corresponding other portion and rising perpendicularly from a base, the other portion narrowing to the other at an exit end of the base.

OBJECTS AND ADVANTAGES

Accordingly, one object is to enable the golfer to concentrate without having to bend over or fumble around the ground for golf balls. This feature will be most helpful to all golfers and professionals who give golf lessons to others. Practice sessions on the driving range will be speeded up, thus increasing income for the owners. The golf ball dispenser basic principle is adaptable to permanent installations at golf-ball driving ranges as further ramifications will occur to those skilled in the art upon reading the description and studying the drawings. Other objects and advantages include the following; to help a golfer develop a swing rhythum; to reduce tiredness; to protect the back; to eliminate stooping; to help improve golf scores on the course; and to encourage golfers to spend more time in practice sessions.

Further objects and advantages will become apparent from the ensuing descriptions and drawings.

DRAWINGS

FIG. 3 is a view in perspective of a golf ball release and transfer assembly used in the device of FIG. 1.

FIG. 4 is a front view of an upper portion of the pivot arm assembly used in the device of FIG. 1.

FIG. 5 is a bottom view of the upper portion of the pivot arm assembly of FIG. 1.

FIG. 6 is a side view of the upper portion of the pivot arm assembly of FIG. 1.

FIG. 7 is a front view of the pivot arm with a pulley attached.

FIG. 8 is a top view of a positioning and centering device in the device of FIG. 1.

FIG. 9 is a side view of a positioning and centering device used in the device of FIG. 1.

Figure 16:
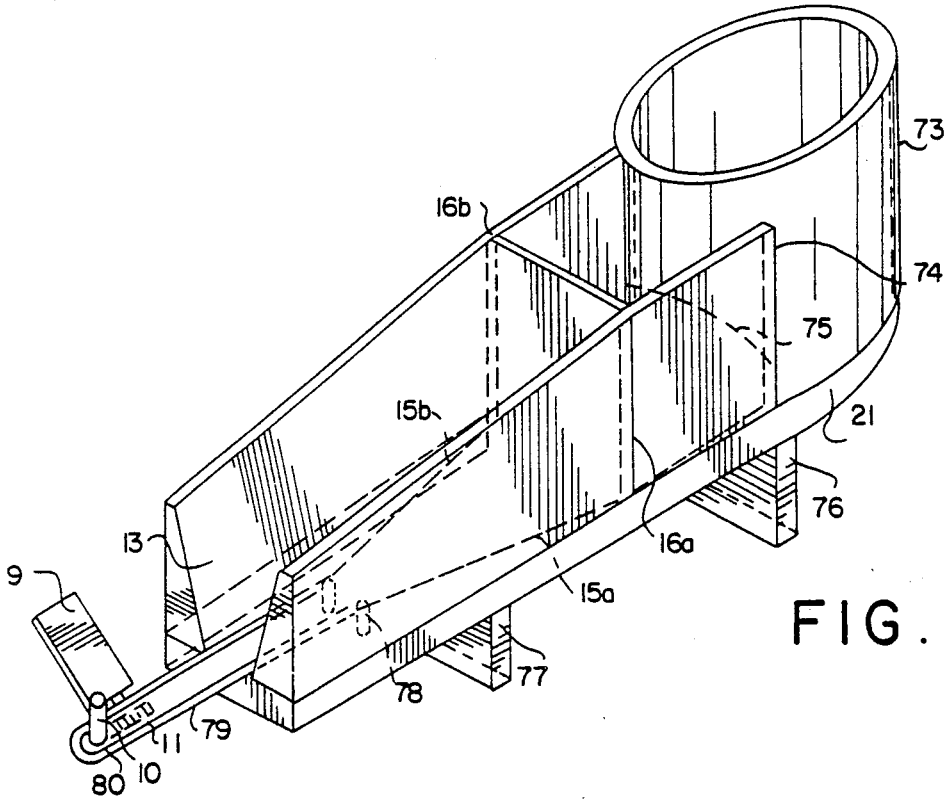
Figure 12:
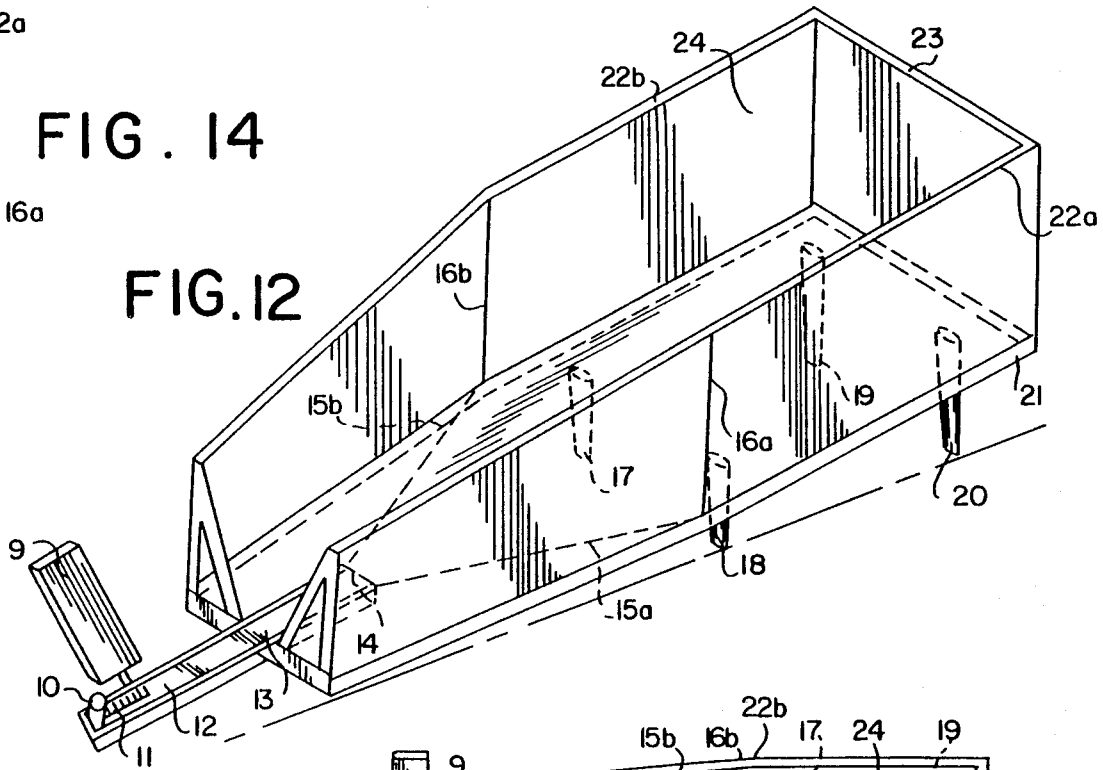
FIG. 12 is an illustration in perspective of a golf ball dispenser in accordance with the invention.

FIG. 16, an illustration in perspective of golf-ball dispenser using a different design than that shown in FIG. 12.

Figure 15:
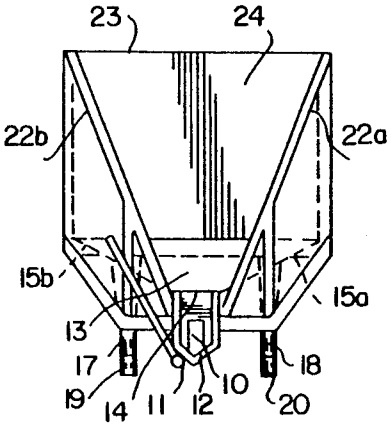
FIG. 15 is an end view of the golf ball dispenser (exit end).
Figure 19:
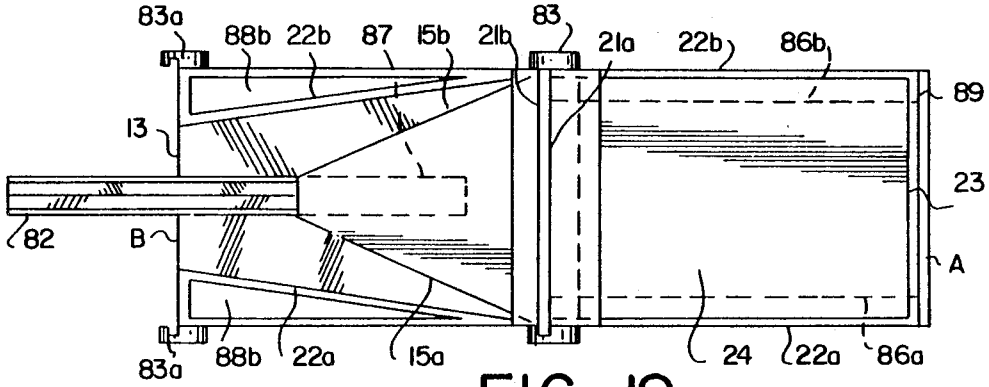
Figure 17:
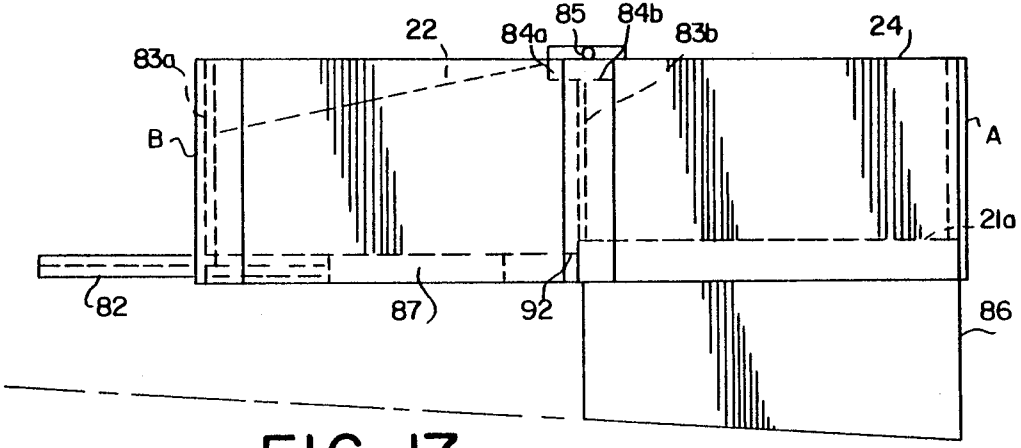
Figure 20:
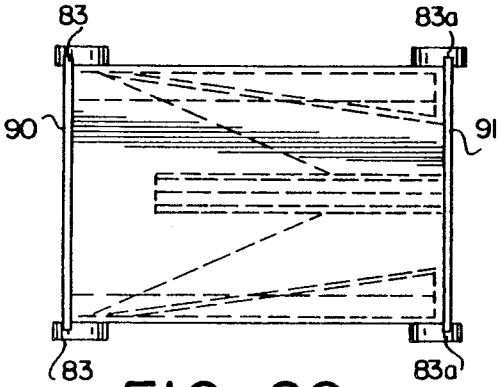
Figure 18:
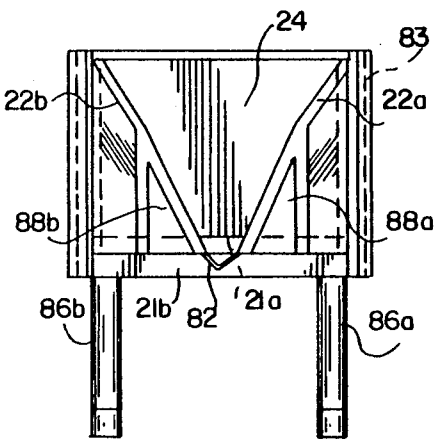

FIG. 17 shows a side view, FIG. 15 shows an end view, FIG. 19 shows a top view, and FIG. 20 shows a top view when closed of of an alternate design which can be used for providing a portable golf-ball dispenser.

REFERENCE NUMERALS

9. Plastic strip
10. Golf ball stop
11. Spring
12. Golf ball guide channel or runner
13. Golf ball exit end of dispenser
14. Golf ball entry point into guide channel
15. Inner lining curve point at bottom of dispenser (broken lines)
16. Starting point of inner lining slope toward golf ball guide channel
17. One of two front legs supporting dispenser
18. One of two front legs supporting dispenser
19. One of two rear legs supporting dispenser
20. One of two rear legs supporting dispenser
21. Base or floor
22. Sidewalls of dispenser receptacle
23. Back wall of dispenser receptacle 24. Opening at top of dispenser receptacle
25. Base
26. Restraining pin
27. Activating pedestal
30. Lever or levers
32. Pulley cable
33. Pulley
34. Frame
35. Spindle or shaft
36. Golf ball guide track
37. Golf ball holding receptable (dispenser)
38. Tee
39. Base for tee
40. Grooved circular post
42. Spacers
43. Pivot arm
44. Positioning and centering device
45. Opening
49. Pivot arm
50. Connecting plate
51. Spring
52. Connecting plate
55. Spindle or shaft
57. Spindle or shaft
58. Side arms
59. Guard plate
60. Golf ball receiver
73. Circular wall of golf ball dispenser receptacle
74. Sidewall
75. Eliptical opening in golf ball dispenser receptacle
76. Rear leg support for golf ball dispenser
77. Front leg support for golf ball dispenser (shorter than rear leg to provide slope toward exit end of golf ball dispenser)
78. Recess to base 21 to receive ends of circular rods 79
79. Circular rods or guide rails
80. Bracket holding golf ball stop 10
81. Platform, base or mat with tee 38
93. Nuts
94. Washers
95. Bushings or bearings
97. Flange
98. Connecting rod
99. Golf-ball stop (upper)
100. Golf-ball stop (lower)
102. Holes, slotted on each side of frame

DESCRIPTION—FIGS. 1 TO 9

Figure 1:
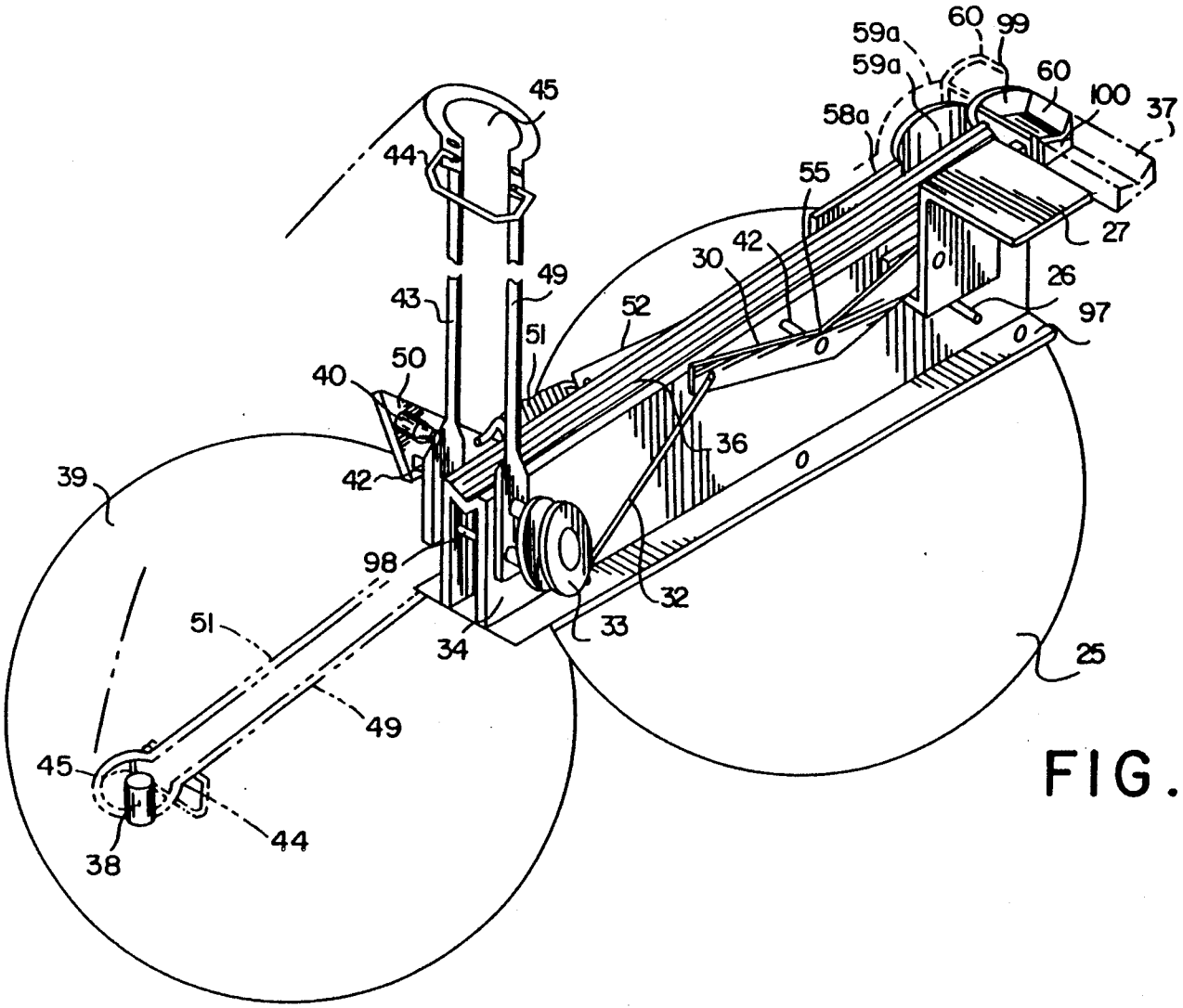
FIG. 1 is an illustration in perspective of a teeing device and mat utilizing a hand-operated control by the golfer.

FIG. 1 shows a teeing device designed for use with a golf ball dispenser 37. Dispenser 37 is placed alongside a golf-ball receiver 60, dispenser 37 has a slightly elevated descent, thereby to allow a single line of golf balls to flow by gravity into receiver 60.

Figure 2:
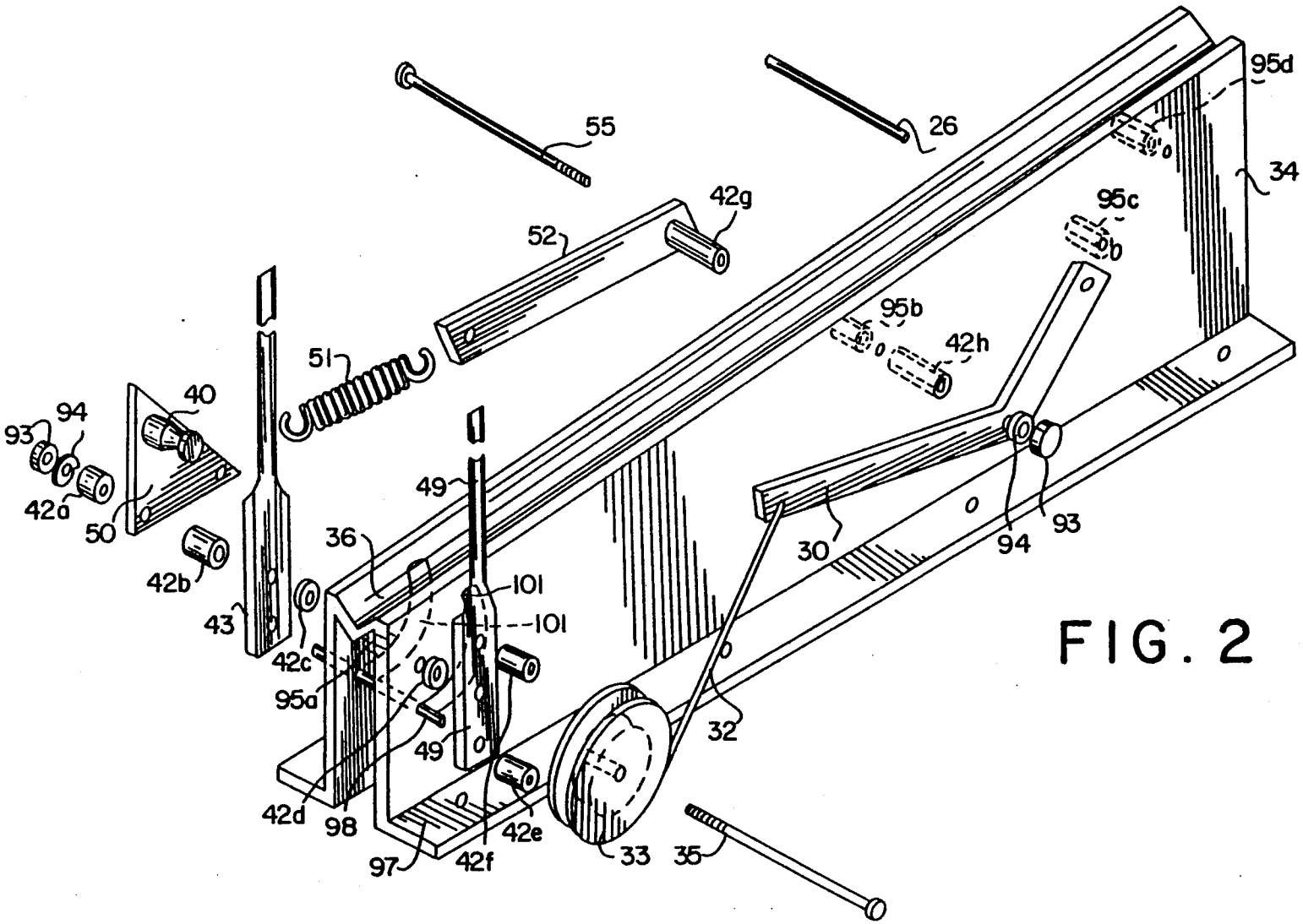
FIG. 2 is an exploded view in perspective of a portion of the parts used with the teeing device of FIG. 1.

A golf ball release and transfer assembly (FIGS. 1 and 3) consists of a spindle 57 which interconnects two side arms 58*a* and 58*b*, spindle 57 is locatingly supported above a base a base 25 by a frame 34. The upper ends of these side arms are joined to golf-ball receiver 60. Side arm 58*b* has an upwardly extending activating pedestal 27 which is the activating point for the golf ball release and transfer assembly as well as pivot arms 43 and 49 of a pulley-spindle assembly (FIGS. 1 and 2).

The golfer activates the teeing device by depressing upwardly extending activating pedestal 27. A restraining pin 26 limits movement of the golf-ball release and transfer assembly.

A spindle shaft 35 (FIGS. 1 and 2) extends through pivot arms 43 and 49, supporting framework 34, and connecting plate 50.

Shaft 35 is locatingly supported by the frame 34. Shaft 35 protrudes a bushing or bearing 95, designated 95*a* in FIG. 2, that extends within frame 34. Other bearings, designated 95*b*, 95*c*, and 95*d*, are similarly provided in frame 34, for shaft 55, restraining pin 26, and shaft 57. A spring 51 is attached to connecting plate 50 and is secured to shaft 55. A grooved circular post 40 is affixed to connecting plate 50 in such a manner that when acted upon by pivot arm 43, plate 50 provides the required tension upon spring 51.

A connecting rod 98 is positioned at the lower end of each of pivot arms 43 and 49 and extends through holes 101 in frame 34. Holes 101 are slotted to insure alignment of the two pivot arms. In effect this limits movement of pivot arms 43 and 49 to approximately 90 degrees.

Thus arms 43 and 49 are operable between a retractable or raised position, indicated by the solid lines in FIG. 1, and an extended or lowered position, indicated by the dashed lines in FIG. 1. The lowered position of arms 43 and 45 occurs when activating pedestal 27 is rotated about shaft 57 into contact with restraining pin 26.

Mat 39 containing tee 38 (FIG. 1) has been separated from the teeing device. An opening in mat 39 is shaped to receive the front portion of the teeing device so that the mat and the teeing device can be interlocked into proper position. Tee 38 is so positioned that when the teeing device is placed within the opening at the outer end of the pivot arm assembly, tee 38 is properly aligned.

Spacers 42 (FIG. 2) are required at various points on the shafts in order to provide clearances for free movement of the component parts and insure satisfactory operation. In addition, a variety of washers, screws, bolts, nuts, rivets, and other such items are required, but are not shown on the drawings for simplification of illustration. These items and their use are well known to those skilled in the art.

Positioning arm 44 (FIGS. 1, 8 and 9) allows the pivot arm assembly to be properly positioned above tee 38. A commecting plate 52 is positioned between spring 51 and shaft 55.

Most component parts of the teeing device are preferably made of aluminum or plastic materials. The mats can be either ruberized or plastic construction, as may be most suitable.

The teeing device shown in FIG. 1 is approximately 55.88 cm (22 inches) long and approximately 15.24 cm (six inches) wide the widest point.

DESCRIPTION—FIGS. 10 AND 11

Figure 10:
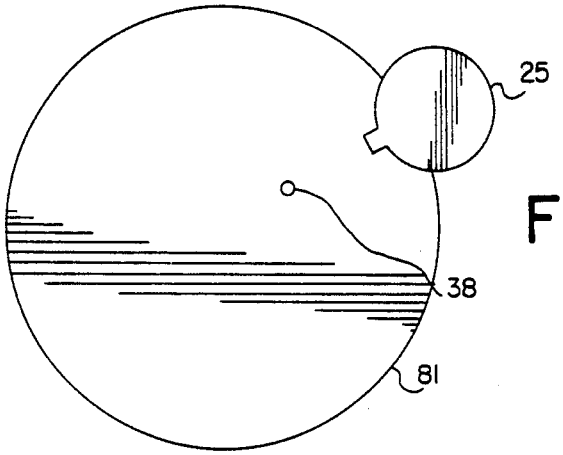
FIG. 10 is a top view of a standing platform or mat with tee used in the device of FIG. 1.
Figure 11:
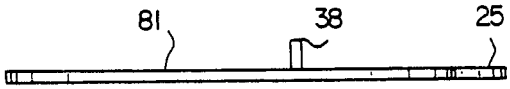
FIG. 11 is an end view of the standing platform or mat with tee.

FIGS. 10 and 11 illustrate a golfer's standing platform, base, or mat. Tee 38 is so positioned that when the teeing device (illustrated by its base 25) is inserted into an opening at one end of the platform 81, the teeing device will be properly aligned as intended.

DESCRIPTION—FIGS. 12 TO 15

FIGS. 12 to 15 show isometric, top, flattened-out, and a front end view respectively of a golf-ball dispenser according to the invention. It comprises a trough shapped holder 24 with side walls 22*a* and 22*b*, a back wall 23, and floor 21. Holder 24 is supported by legs 17, 18, 19, and 20. Plastic strip 9 is attached to spring 11, which in turn is affixed to golf-ball guide channel 12. Golf-ball stop 10 is attached to channel 12 in order to stop golf balls at a position opposite strip 9. Inner linings 15*a* and 15*b* (indicated by broken lines) show the position of a curve at the bottom of holder 24, and also shows the gradually narrowed path that golf balls have to travel toward the opening provided by channel 12 to exit end 13.

Sidewalls 22*a* and 22*b*, backwall 23, and floor 21 can be any suitable material, such as wood, metal, metal or plastic. For left handed golfers strip 9 is mounted on the opposite side from that shown in FIG. 12. Legs 17 and 18 are shorter than legs 19 and 20, thus causing the dispenser to slope downwardly toward exit end 13.

Figure 14:
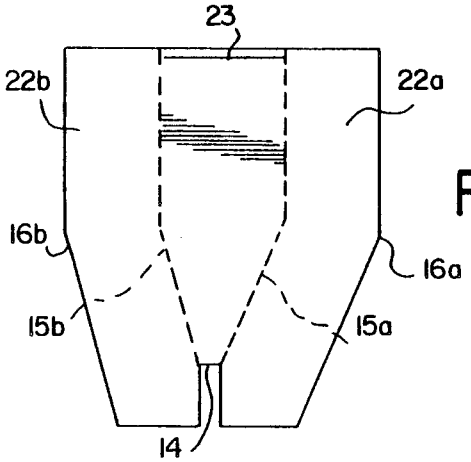
FIG. 14 shows the shape of the interior of the golf ball dispenser as if in a flattened position (excluding the back side) as opposed to its configuration as shown in FIG. 12.

FIG. 14 shows the shape of the interior of the dispenser as if in a flattened-out position (excluding back side 23) as opposed to its normal configuration shown in FIG. 12.

The dispenser shown in FIG. 12 is approximately 66 cm (26 inches) long, not including golf ball guide channel 12 which extends out 15.2 cm (6 inches). Holder 24 is 22.9 cm (9 inches) wide and 33 cm (13 inches) long up to starting points 16*a* and 16*b* of inner lining slope toward the guide channel, beyond which the width of exit 13 is 14 cm (5½ inches). The top of holder 24 is 26.7 cm (10½ inches) above ground level in the example shown.

These measurements are somewhat dictated by the normal path of golf balls dumped into holder 24. However these measurements can be extended to provide increased capacity.

DESCRIPTION—FIG. 16

FIG. 16 shows one example of the golf ball dispenser where a circular hopper or receptacle 73 is mounted on a base 21. Receptacle 73 has an eliptical opening 75 which allows golf balls to leave the receptacle into the area bounded by side walls 74, 16*a*, and 16*b*. At points 16*a* and 16*b*, walls 15*a* and 15*b* of the interior lining gradually narrow toward the opening at exit 13. This will cause golf balls to form a single file into and between circular rods or guide rails 79.

Eliptical opening 75 of receptacle 73 has a height above base 21 exceeding the diameter of two golf balls.

Strip 9 is attached to spring 11, which is in turn affixed to guide rails 79 by attachment to bracket 60. Leg 76 is longer than leg 77 so as to provide a downward slope toward end 13. A recess 78 is provided for each end of circular rod or guide rail 79 in order to secure the ends in their proper position during operation. Also the recesses make it possible to remove the entire unit, including strip 9, stop 10, spring 11, guide rail 79, and bracket 80.

DESCRIPTION—FIGS. 17 TO 20

FIGS. 17 to 20 show a side view, an end view, and two top views, including one view when closed, of an alternative golf-ball dispenser according to the invention. It comprises a dispenser similar to that shown in FIG. 1, except that troughed-shaped holder 24 has been separated into two sections. Section A has upstanding sidewalls 22*a* and 22*b* extending up from base 21*a* from opposite sides of base 21*a*, one portion of each sidewall 22 facing a corresponding portion of the other sidewall.

Section B has a portion of each of its sidewalls 22*a* and 22*b* facing a corresponding other portion of the other sidewall. The sidewalls gradually converge closer together at end 13. Sections A and B are joined by a hinge (or hinges) 85 so that section B can be inverted or placed atop section A for portability.

Brackets 83 have slots which are provided for panels (not shown). These panels are inserted into brackets 83 when section A and B are closed. This will provide a closed container for golf balls when they are transported. By the addition of a handle and security latches (not shown), the convenience of portability has been provided.

This embodiment has a provision for guide channel 82 to be retractable into a recess 87 within base 92. The level of base 92 is below base 21*a* so as to provide additional momentum for balls proceeding from section A to section B. Frame 84*a* supports hinge (or hinges) 85, as does frame 84*b*. Wedge-shaped legs 86 provide for proper slope. Speces 88*a* and 88*b* are between the inner linings and outer walls. Ledge 89 is provided for enclosure panels (not Shown). FIG. 19 shows the position for placement of enclosure panels 90 and 91 when section A is closed and section B is inverted over section A.

OPERATION OF GOLF-BALL TEEING DEVICE

A single line of golf balls passes onto to the release and transfer assembly of the teeing device from dispenser 37. Each golf ball is transferred to a fixed tee as follows: The golfer activates the teeing device by using his or her golf club to depress the upwardly extending activating pedestal 27. Side arm 58*b* is connected to activating pedestal 27 and is interconnected to lever 30. Cable 32 and pulley 33 are affixed to spindle shaft 35, which is attached to pivot-arm assembly 43–49. Pivot-arm assembly 43–49 has a ball centering device with a hole 45 at the top end to receive the ball. Pivot-arm assembly moves approximately 90 degrees from an upright position to a position centered over tee 38.

When pedestal 27 is activated, receiver 60 moves upward rapidly in a sudden action, thereby propelling a ball upward and in the direction of track 36 between plates 59*a* and 59*b*. Another ball automatically falls into position on receiver 60 from holding receptacle 37 which is supplied by the dispenser.

Stop 99 allows only one ball to be positioned on receiver 60. Other balls from the dispenseer do not move onto receiver 60 when activating pedestal 27 returns to its prior or normal position. This is accomplished by stop 100 which prevents other balls from moving. When stop 100 returns to its normal position, another ball advances into receiver 60.

Activating pedestal 27 is held down by the golfer while the ball approaches the end of channel 36. At this time, the ball continues its downward course between pivot arms 43 and 49. Since the spacing between arms 43 and 49 is somewhat less than the diameter of a golf ball, the ball is supported on top of and between arms 43 and 49, and thense continues by gravity to center itself over, opening 45 which has a diameter larger than a ball. Thus the ball is centered onto tee 38. Upon release of pedestal 27, the pivot arm assembly returns to an upright or vertical position, this being accomplished by action of spring 51.

OPERATION OF GOLF BALL DISPENSER

A multitude of golf balls, such as a bucket of balls normally found at a golf driving range, are dumped into top opening of holder 24 of the dispenser. The dispenser (FIGS. 12, 16, and 17) is designed in such a manner that balls within form a pattern which allows a single line of balls to roll out exit end 13 onto runner 12 or 79 until the lead ball strikes stop 10, and at that point the flow of balls ceases. The dispenser is now ready to be used by the golfer for chipping, pitching, putting or driving, as may be desired.

Figure 13:
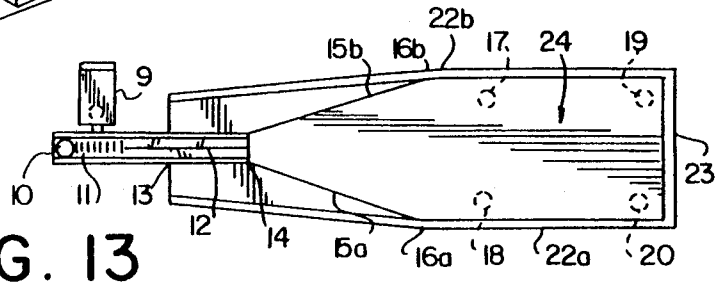
FIG. 13 is a top view of the golf ball dispenser.

The golfer strikes strip 9 with his or her golf club. This pushes a single golf ball onto ground or other surface where the ball can be hit. Alternatively the ball can be placed on a tee, if desired for practice sessions. Note that the dispenswer in FIGS. 12, 13, and 15 is designed for use with a teeing device, all units described being a part of this invention.

As noted, dispenser is adaptable to supply golf balls to a teeing device. When the dispenser is used in combination with a teeing device, strip 9 and stop 10 are not required.

SUMMARY, SCOPE AND RAMIFICATIONS

Thus the reader will see that I have provided a method and apparatus for conveniently and automatically positioning golf balls on a tee so they can be hit by a club in the hands of a golfer. This is accomplished by enabling the golfer to activate the entire operation with his or her golf club from his position or stance.

The teeing device is simple in design and quite versatile in that the unit is small and adaptable to a variety of golf ball dispensers which can be either fixed to the frame or removable.

The teeing device can be used with two different sizes of mats with fixed tees. Both of these mats have an opening which allows the teeing device to be so positioned within the opening at the outer end of the pivot arm assembly that the tee is properly aligned. One of the mats is small for portability. The other is much larger so as to enable the golfer to stand upon the mat while hitting golf balls in practice sessions.

The dispenser is simple in design, only requiring that the golfer dump a multitude of golf balls into holder, and from then on, he or she need merely provide a gentle tap to a plastic strip in order to have a golf ball at the point of play. Efficiency and reliability with less maintenance are obtained by use of fewer parts. Fewer back pains are suffered from bending or stooping than with the use of prior-art devices. Additional advantages are provided for the golf ball dispenser, namely, it is light in weight, and portable by virtue of its fabrication in plastics, thus reducing the cost of manufacturing and lowering the selling price, thereby increasing its availabliity to the average golfer. Also its portability encourages golfers to spend more time in practice sessions with less effort, thus enabling the golfer to achieve lower scores on the golf course.

Other embodiments can employ a circular (instead of rectangular) configuration for holder 24; an entirely different design in shape and configuration such as will be possible with the use of plastics; the legs can be rigid or detachable, or adjustable in height; and circular rods can be used for runners, guide rails or tracks, or other means which will occur to those skilled in the art upon reading disclosure set forth hereinbefor and the drawings related thereto.

While this description contains many specificities, these should not be construed as limitations on the scope of the invention, but rather as an exemplification of one preferred embodiment thereof. Other embodiments can be used for activation of the teeing device, such as a foot pedal, a remote control, or electronic or other means. Further ramifications will occur to those skilled in the art upon reading the above description and studying the drawings.

Accordingly, the scope of our invention should be determined not by the embodiment illustrated, but by the appended claims and their legal equivalents.

We claim:

1. A golf ball dispenser, comprising, a golf ball container having a planar bottom wall having first and second ends, a pair of spaced apart side walls and an end wall, said end wall and said side walls extending upwards from said bottom wall to an upper edge to form an open top container, said end wall extending across said first end of said bottom wall and being attached to said side walls, said side walls extending parallel to each other a predetermined distance along said bottom wall, said side walls further converging towards each other from said predetermined distance to said second end of said bottom wall to define a narrow opening in said container between said side walls, slope means for causing said container to slope downwards from said first end towards said second end;

a guide channel having an elongated base and upstanding elongated parallel side members at opposite side edges of said base, said side members being spaced a predetermined distance so as to guide golf balls of a predetermined size in single file along said guide channel, said guide channel having an entrance end and an exit end, said guide channel extending a predetermined distance through said opening between said side walls of said container such that said entrance end lies within said container to receive golf balls, and said exit end being external of said container, said guide channel sloping downwardly from said entrance end towards said exit end to thereby cause balls to roll by gravity from said entrance end to said exit end; stop means at said exit end for stopping balls;

a pair of interior lining walls within said container, each said interior lining wall being attached to the upper edge of a respective side wall and extending to said guide channel at said second end opening and further extending from said guide channel to a respective side wall at said predetermined distance; and means at said exit end for manually releasing balls from said channel one at a time.

2. The dispenser of claim 1 wherein said slope means comprises four legs supporting said bottom wall of said container, a first pair of said four legs under said second end and a second pair of legs under said first end of said container, said first pair of legs being shorter than said second pair of legs.

* * * * *